US005120428A

United States Patent [19]

Ikura et al.

[11] Patent Number: 5,120,428

[45] Date of Patent: Jun. 9, 1992

[54] DEASHING OF HEAVY HYDROCARBON RESIDUES

[75] Inventors: Michio Ikura, Kanata; Norman E. Cooke, Westmount; Marc Halevy, Burlington; Martin E. Weber, Pointe Claire, all of Canada

[73] Assignee: Energy Mines & Resources Canada, Ottawa, Canada

[21] Appl. No.: 711,031

[22] Filed: Jun. 6, 1991

[51] Int. Cl.[5] ..... C10G 21/00

[52] U.S. Cl. ..... 208/188; 210/708; 208/428; 208/311; 208/308; 208/87; 208/88; 208/97; 208/3; 208/187

[58] Field of Search ..... 208/308, 311, 188, 87, 208/88, 97, 428; 210/708

[56] References Cited

U.S. PATENT DOCUMENTS

| | | | |
|---|---|---|---|
| 2,789,083 | 4/1952 | Hardy | 196/50 |
| 4,058,453 | 11/1977 | Patel et al. | 208/188 |
| 4,121,995 | 10/1978 | Hsu | 208/8 |
| 4,250,021 | 2/1981 | Salsinszky | 208/181 |
| 4,407,706 | 10/1983 | Merchant et al. | 208/188 |
| 4,407,707 | 10/1983 | Merchant, Jr. et al. | 210/708 |
| 4,416,754 | 11/1983 | Merchant, Jr. et al. | 208/188 |
| 4,434,850 | 3/1984 | McCoy | 210/708 |
| 4,444,654 | 4/1984 | Cargle et al. | 210/708 |
| 4,539,100 | 9/1985 | Ronden | 208/188 |
| 4,600,501 | 7/1986 | Poirier | 208/188 |
| 4,614,593 | 9/1986 | Roark | 210/708 |
| 4,634,520 | 1/1987 | Angclov et al. | 210/708 |
| 4,808,299 | 2/1989 | Latimer et al. | 208/251 |
| 4,895,641 | 1/1990 | Briceno et al. | 210/708 |

FOREIGN PATENT DOCUMENTS 1027502 3/1978 Canada .

OTHER PUBLICATIONS

Pluronic & Tetronic Surfancts, BASF Publication, 1989.

Rosen, M. J. *Surfactants and Interfacial Phenomena*, 2nd Ed. John Wiley & Sons, 1989.

*Primary Examiner*—Helane Myers

[57] ABSTRACT

A process is described for removing mineral or ash constituents from heavy hydrocarbon residues, such as those resulting from coal-oil coprocessing, residue hydrocracking or coal liquifaction. The process comprises the steps of: (a) intimately mixing the ash-containing heavy hydrocarbon oil residue with a surfactant and a pH-conditioned aqueous solution under high shear mixing conditions to disperse the ash-containing residue in the aqueous phase thereby creating a fine oil-in-water emulsion, (b) adding a strong oxidizing agent to the emulsion to thereby break the emulsion and release the ash into the aqueous phase and (c) separating the ash-containing aqueous phase from the oil phase. The HLB method for characterizing the emulsion forming activity of a surface active material is described in M. J. Rosen, *Surfactants and Interfacial Phenomena*, John Wiley & Sons, New York (1989), incorporated herein by reference.

10 Claims, No Drawings

DEASHING OF HEAVY HYDROCARBON RESIDUES

BACKGROUND OF THE INVENTION

This invention relates to the removal of mineral or ash constituents from heavy hydrocarbon residues, and particularly from residues resulting from coal-oil co-processing, residue hydrocracking and coal liquifaction.

Hydrogenation processes, such as hydrocracking, are commonly used for the conversion of heavy hydrocarbon oils to lighter products and for the coprocessing of heavy hydrocarbon oils and coal. When carbonaceous material, such as coal, is simultaneously hydrogenated with a heavy hydrocarbon oil, it undergoes liquifaction leaving behind particles consisting of carbonaceous material plus mineral material or ash which are inert to further hydrogenation. Thus, the mineral matter or ash (referred to hereinafter as "ash") becomes part of the heavy bottoms product or residue from the coprocessing.

The mineral matter or ash content of these residues can play a very important role in the economics of any processes for utilizing such residues. Because of the complex changes that the heavy hydrocarbon oils and mineral matter undergo, the reduction of ash particles from heavy hydrocarbon residues has proven to be a most difficult problem to solve.

In the past, a number of schemes have been tried for removing ash particles as part of coal liquefaction technology. Among techniques that have been attempted, there may be mentioned filtration, solvent extraction, anti-solvent deashing, and critical solvent deashing. In spite of extensive efforts to develop cost effective processes based on the above techniques, there still remains a need for a simple and inexpensive de-ashing process.

For instance, filtration of residues is most difficult to carry out because of the high viscosity of the mineral-containing hydrogenation residues. As a variation of this technique, filtration has been combined with centrifugation to accelerate the settling rate of the solids in the residues.

Solvent extraction of residues to separate ash is very simple in concept and works quite well on laboratory scale. However, in operations at commercial levels, the costs of solvents recovery become prohibitive.

In anti-solvent deashing, a so-called "antisolvent" is added to heavy hydrocarbon residues containing ash to dilute the residual oil and to promote the aggregation/-coagulation of solids (mainly mineral matter) by the precipitation of preasphaltenes. Large agglomerates result and these settle at high rates. Subsequently, the residual oil is divided into two streams: an ash lean-stream and an ash-rich stream. Solids are removed by vacuum distillation of the ash-rich stream. It is also possible to use a centrifuge to further increase the particle settling rate.

In critical solvent deashing, an appropriate light hydrocarbon liquid and a super critical gas are used to solubilize ash-containing residual oil and to form low viscosity critical fluid. It has been known that a critical fluid solubilizes very large molecules. Ash particles settle rapidly by gravity in the critical fluid medium. Then, the critical fluid is divided into an ash-lean stream and an ash-rich stream. Ash is rejected from the ash-rich critical fluid stream by physical means, such as flashing, centrifugation or a combination of both. The clean residual oil is recovered by flashing the ash-lean critical fluid stream. The super critical gas and the light hydrocarbon liquid are recycled to the system. The phase behaviour of a multi-component critical fluid can be manipulated by adjusting temperature and pressure to cause phase separation within the critical fluid. When such process is applied to a decanter, a significant portion of the solids free critical fluid can be recovered without resorting to vaporization. This has been found to be a significant advantage over simple solvent extraction and it is known that the process works. However, the operation is sensitive to the nature of residues since the entire concept depends on the solubility of the residues to give a combination of super critical gas and light hydrocarbon. Moreover, the processing time is relatively long and the oil and solvent losses that leave with the rejected solids are high.

In all of the above processes, the ash particles settle through a viscous oil medium, which often requires dilution.

A de-ashing process is also described in Hardy, U.S. Pat. No. 2,789,083 in which a small amount of water is mixed with hydrocarbon oil and the mixture is allowed to settle to form a clear oil layer, a water phase and an aqueous emulsion layer. These layers are then separated and the emulsion is heated to a temperature above 500° F. to break the emulsion as well as to decompose the oil soluble metallic compounds to metal fines which can then be removed by conventional means, such as filtration.

It is the object of the present invention to be able to remove ash particles from heavy hydrocarbon residues without the necessity of having the ash particles settle through the viscous oil.

SUMMARY OF THE INVENTION

According to the present invention, it has been found that mineral or ash contaminants can be removed from heavy hydrocarbon residues by (a) intimately mixing the ash-containing heavy hydrocarbon residue with a surfactant and pH-conditioned aqueous solution under high shear mixing conditions to disperse the ash-containing residue in the aqueous phase thereby creating a fine oil-in-water emulsion, (b) adding a strong oxidizing agent to the emulsion to thereby break the emulsion and release the ash into the aqueous phase and (c) separating the ash-containing aqueous phase from the oil phase.

The heavy hydrocarbon oil is typically a bitumen or heavy oil, but it may also be a topped bitumen, topped heavy oil or residuum. It typically contains a large proportion, usually more than 50% by weight, of material boiling above 524° C., equivalent atmospheric boiling point.

The oxidizing agent is preferably hydrogen peroxide, but other strong oxidizing agents can be used such as sodium hypochloride, sodium perchlorate, etc. that have equivalent oxidation/reduction potential values to those of hydrogen peroxide.

The ash-containing heavy hydrocarbon residues may require some diluting for viscosity reduction. This can conveniently be done by adding a diluent such as toluene, kerosene, etc., usually in amounts of up to 5% based on the total residue content. The processing is usually carried out at temperatures in the range of 80° to 95° C. at atmospheric pressure. However, when the residue is a very heavy end, such as vacuum bottoms, it may be necessary to raise the temperature above 120° C.

to achieve lower oil viscosity. That requires the use of a pressurized system.

DESCRIPTION OF THE PREFERRED EMBODIMENTS

According to one preferred embodiment of the invention, the process is carried out using a non-ionic surfactant having a HLB (Hydrophil-Lipophil Balance) number between 1 and 6. The aqueous phase in this procedure has a pH in the range of 9 to 10. The oil and surfactant are vigorously mixed to form an oil-in-water emulsion and hydrogen peroxide is then added to the emulsion to break the emulsion. Typically, more than 9% by weight of hydrogen peroxide (on solution basis) is required for this purpose. The oil component floats to the surface and the ash settles to the bottom of the aqueous phase.

In the above procedure, the low HLB number of the surfactant promotes formation of a water-in-oil emulsion because it is strongly lipophilic and reduces the surface tension of the oil as well as enhancing the draining of oil from the surface of the ash particles.

In a second process embodiment of the invention, the above procedure is repeated, but using a non-ionic surfactant having a HLB number higher than 15. For this procedure, the aqueous solution preferably has a pH in the range of 7 to 10. This surfactant with the high HLB number is primarily hydrophillic and, when added to the ash-containing oil, attaches itself to ash particles and give the ash particles a more hydrophillic nature. The ash particles are rejected to the aqueous phase and then remain in the aqueous phase.

In a third embodiment, either one of the first two embodiments can be repeated to further clarify the oil. In the second stage, however, no additional surfactant is required for emulsification.

EXAMPLE 1

A heavy hydrocarbon residue was obtained from the coprocessing of a very heavy hydrocarbon oil (+525° C. vacuum tower bottoms cut from Lloydmister Saskatchewan heavy oil) and coal (Willowbunch Saskatchewan lignite). It consisted of a +525° C. coprocessing residue, coprocessing heavy gas oil and a small amount of coprocessing light gas oil. Solvent extraction and ashing of this oil showed the following characteristics:

| | |
|---|---|
| Pentane insolubles | 17.7 wt %. |
| Toluene insolubles | 11.4 wt % |
| THF (tetrahydrofuran) insolubles | 9.2 wt % |
| Ash | 5.8 wt % |

Tests were conducted in a 2 L Pyrex beaker using a high speed homogenizer (Brinkman, Model PT 10/35), which combines mechanical shearing action and cavitation. The coprocessing heavy ends were heated to approximately 120° C. with non-ionic surfactant having a HLB values ranging between 1.0 and 6.0. Water with a pH of 9.2–9.5 was also heated to its boiling point. The preheated coprocessing heavy ends were then added thereto. They were mixed at high shear so that the heavy ends would be homogenized in the aqueous solution to form an oil-in-water emulsion. The emulsion was kept on a hot plate to maintain it near 100° C.

In order to break the emulsion, a hot solution of hydrogen peroxide was added thereto with mixing and the resulting slurry was left to boil. It was found that the oil component floated to the surface, while the ash settled to the bottom of the aqueous phase.

The processing conditions and results for a series of tests based upon the above procedure are shown in Table A below:

TABLE A

| | |
|---|---|
| Temperature: | 95° C. |
| Oil Diluent: | Toluene |
| Impeller speed: | 7,000–10,000 rpm |
| Aqueous conditioner: | NaOH |
| Hydrogen peroxide concentration: | 35% |
| Run Duration: | 3 min. |

| Surfactant (g) | Oil (g) | Diluent (g) | pH | Water (g) | Hydrogen Peroxide (g) | Ash rejection (wt %) |
|---|---|---|---|---|---|---|
| 0.70 (BASF L101, HLB = 1.0 | 8.73 | 0.57 | 9.30 | 400 | 200 | 11.2 |
| 0.42 (BASF L61, HLB = 3.0 | 6.02 | 0.46 | 9.25 | 600 | 300 | 43.8 |
| 0.25 (BASF L61, HLB = 3.0) | 5.76 | 0.34 | 9.54 | 600 | 300 | 36.1 |
| 0.18 (BASF T1102, HLB = 6.0 | 3.24 | 0.18 | 9.50 | 500 | 150 | 19.2 |

EXAMPLE 2

The same heavy hydrocarbon residue was used as in Example 1, but for this test non-ionic surfactants were used having HLB numbers in the range of 24.5 to 30.5. The aqueous solution used had pH values in the range of 7.5 to 9.6.

The processing conditions and results obtained are shown in Table B below:

TABLE B

| | |
|---|---|
| Temperature: | 95° C. |
| Oil Diluent: | Toluene |
| Impeller speed: | 7,000–10,000 rpm |
| Aqueous conditioner: | NaOH |
| Hydrogen peroxide concentration: | 35% |
| Run Duration: | 3 min. |

| Surfactant (g) | Oil (g) | Diluent (g) | pH | Water (g) | Hydrogen Peroxide (g) | Ash rejection (wt %) |
|---|---|---|---|---|---|---|
| 0.03 (BASF F77, HLB = 24.5 | 10.09 | 0.05 | 9.6 | 500 | 150 | 17.5 |
| 0.25 (BASF F77/ F108, HLB = 26.0 | 3.93 | 0.27 | 7.5 | 600 | 300 | 16.6 |
| 0.35 (BASF F108, HLB = 27.0) | 6.65 | 0.35 | 8.1 | 600 | 300 | 29.9 |
| 0.44 (BASF F108/ T908, HLB = 29.2 | 6.60 | 0.44 | 8.4 | 600 | 300 | 20.8 |

TABLE B-continued

| | | | | | | |
|---|---|---|---|---|---|---|
| Temperature: | | | | 95° C. | | |
| Oil Diluent: | | | | Toluene | | |
| Impeller speed: | | | | 7,000-10,000 rpm | | |
| Aqueous conditioner: | | | | NaOH | | |
| Hydrogen peroxide concentration: | | | | 35% | | |
| Run Duration: | | | | 3 min. | | |
| Surfactant (g) | Oil (g) | Diluent (g) | pH | Water (g) | Hydrogen Peroxide (g) | Ash rejection (wt %) |
| 0.32 (BASF T908, HLB = 30.5 | 6.40 | 0.55 | 8.1 | 600 | 350 | 14.6 |

EXAMPLE 3

This is a two-stage operation with the first stage being essentially the same as that of Example 1, using a surfactant having a HLB number of 3.0 and an aqueous solution having a pH of 9.3. The first stage was conducted for three minutes and the product from the first stage was subjected to a mixing in a second stage without addition of further surfactant, the second stage mixing again being for three minutes.

The processing conditions and results obtained are shown in Table C below:

TABLE C

| | | | | | | |
|---|---|---|---|---|---|---|
| Temperature: | | | | 95° C. | | |
| Oil Diluent: | | | | Toluene | | |
| Impeller speed: | | | | 7,000-10,000 rpm | | |
| Aqueous conditioner: | | | | NaOH | | |
| Hydrogen peroxide concentration: | | | | 35% | | |
| Run Duration: | | | | 3 min./stage | | |
| Surfactant (g) | Oil (g) | Diluent (g) | pH | Water (g) | Hydrogen Peroxide (g) | Ash rejection (wt %) |
| Stage 1 | | | | | | |
| 0.46 (BASF L61, HLB = 3.0 | 6.13 | 0.41 | 9.3 | 600 | 350 | 28.8 |
| Stage 2 | | | | | | |
| 0 | 3.20 | 0 | 9.3 | 400 | 200 | 54.5 |
| Combined two-stage ash rejection = 67.6 | | | | | | |
| Stage 1 | | | | | | |
| 0.46 (BASF L61, HLB = 3.0) | 6.88 | 0.46 | 9.3 | 600 | 300 | 32.1 |
| Stage 2 | | | | | | |
| 0 | 4.60 | 0 | 9.3 | 450 | 250 | 59.2 |
| Combined two-stage ash rejection = 72.3 | | | | | | |
| Stage 1 | | | | | | |
| 0.43 (BASF L61, HLB = 3.0) | 7.44 | 0.43 | 9.3 | 600 | 275 | 36.8 |
| Stage 2 | | | | | | |
| 0 | 4.15 | 0 | 9.3 | 600 | 300 | 50.4 |

TABLE C-continued

| | | | | | | |
|---|---|---|---|---|---|---|
| Temperature: | | | | 95° C. | | |
| Oil Diluent: | | | | Toluene | | |
| Impeller speed: | | | | 7,000-10,000 rpm | | |
| Aqueous conditioner: | | | | NaOH | | |
| Hydrogen peroxide concentration: | | | | 35% | | |
| Run Duration: | | | | 3 min./stage | | |
| Surfactant (g) | Oil (g) | Diluent (g) | pH | Water (g) | Hydrogen Peroxide (g) | Ash rejection (wt %) |
| Combined two-stage ash rejection = 68.7 | | | | | | |

All of the BASF surfactants listed in the above examples are block copolymers of ethylene oxide and propylene oxide. These block copolymers are available from BASF under the trade marks PLURONIC ® and TETRONIC ®.

We claim:

1. A process for treating heavy hydrocarbon oil residues containing unfiltrable mineral or ash contaminants, which comprises:

(a) intimately mixing the ash-containing heavy hydrocarbon oil residue with a nonionic surfactant having a hydrophilelipophile balance (HLB) number between 1 and 6 and an aqueous solution at a pH of 9 to 10 under high shear mixing conditions to disperse the ash-containing residue in the aqueous phase thereby creating a fine oil-in-water emulsion, (b) adding a strong oxidizing agent to the emulsion to thereby break the emulsion and release the ash into the aqueous phase and (c) separating the ash-containing aqueous phase from the oil phase.

2. A process according to claim 1 wherein the heavy hydrocarbon oil residue is obtained from heavy oil hydrocracking, coal-oil coprocessing or coal liquifaction.

3. A process according to claim 1, wherein the oxidizing agent is hydrogen peroxide or a mineral acid.

4. A process according to claim 1, wherein the oil phase obtained is subjected to a second stage treatment in which it is mixed with water to form an emulsion and the emulsion is then broken by adding the strong oxidizing agent, release more ash into the aqueous phase.

5. A process according to claim 1, wherein the surfactant is a block copolymer of ethylene oxide and propylene oxide.

6. A process for treating heavy hydrocarbon oil residues containing unfiltrable mineral or ash contaminants, which comprises:

(a) intimately mixing the ash-containing heavy hydrocarbon oil residue with a nonionic surfactant having a hydrophilelipophile balance (HLB) number higher than 15 and an aqueous solution at a pH in the range of 7 to 10 under high shear mixing conditions to disperse the ash-containing residue in the aqueous phase thereby creating a fine oil-in-water emulsion, (b) adding a strong oxidizing agent to the emulsion to thereby break the emulsion and release the ash into the aqueous phase and (c) separating the ash-containing aqueous phase from the oil phase.

7. A process according to claim 6, wherein the heavy hydrocarbon oil residue is obtained from heavy oil hydrocracking, coal-oil coprocessing or coal liquifaction.

8. A process according to claim 6, wherein the oxidizing agent is hydrogen peroxide or a mineral acid.

9. A process according to claim 6, wherein the oil phase obtained is subjected to a second stage treatment in which it is mixed with water to form an emulsion and the emulsion is then broken by adding the strong oxidizing agent, release more ash into the aqueous phase.

10. A process according to claim 6, wherein the surfactant is a block copolymer of ethylene oxide and propylene oxide.

* * * * *